US008947004B2

(12) United States Patent
Chen

(10) Patent No.: US 8,947,004 B2
(45) Date of Patent: Feb. 3, 2015

(54) ELECTRONIC DEVICE

(75) Inventor: Kuo-Tso Chen, Hsinchu (TW)

(73) Assignee: Optromax Electronics Co., Ltd, Hsinchu (TW)

( * ) Notice: Subject to any disclaimer, the term of this patent is extended or adjusted under 35 U.S.C. 154(b) by 1161 days.

(21) Appl. No.: 12/895,878

(22) Filed: Oct. 1, 2010

(65) Prior Publication Data

US 2011/0080101 A1 Apr. 7, 2011

(30) Foreign Application Priority Data

Oct. 2, 2009 (TW) ..... 98133560 A

(51) Int. Cl.
*H05B 37/00* (2006.01)
*H05B 33/08* (2006.01)

(52) U.S. Cl.
CPC ..... *H05B 33/0827* (2013.01); *H05B 33/083* (2013.01)
USPC ..... 315/193; 307/31

(58) Field of Classification Search
USPC ..... 315/193, 291, 294, 297, 312
See application file for complete search history.

(56) References Cited

U.S. PATENT DOCUMENTS

2008/0122376 A1* 5/2008 Lys ..... 315/192
2010/0109570 A1* 5/2010 Weaver ..... 315/295

FOREIGN PATENT DOCUMENTS

JP 2004-119422 4/2004
JP 2007-123562 5/2007
WO 2008060469 5/2008

OTHER PUBLICATIONS

"Office Action of Japan Counterpart Application", issued on Jan. 22, 2013, p. 1-p. 4.

* cited by examiner

*Primary Examiner* — Tung X Le
*Assistant Examiner* — Jonathan Cooper
(74) *Attorney, Agent, or Firm* — Jianq Chyun IP Office

(57) ABSTRACT

An electronic device is provided. The electronic device includes a plurality of load units, a plurality of serial-parallel switch units and a control module. The control module switches the serial-parallel switch units to a first state or a second state according to a level variation of an input voltage. Connection relations of the load units are correspondingly changed according to the level variation of the input voltage. In this way, the electronic device can be driven by an alternating-current voltage.

21 Claims, 12 Drawing Sheets

ELECTRONIC DEVICE

CROSS-REFERENCE TO RELATED APPLICATION

This application claims the priority benefit of Taiwan application serial no. 98133560, filed on Oct. 2, 2009. The entirety of the above-mentioned patent application is hereby incorporated by reference herein and made a part of this specification.

BACKGROUND

1. Field of the Invention

The invention relates to an electronic device. Particularly, the invention relates to an electronic device capable of switching load units according to an input voltage.

2. Description of Related Art

Since a light emitting diode (LED) has advantages of long service life, small size, high shock resistance, low heat generation and low power consumption, it is widely used as indicators or light sources in various home appliances and equipments. In recent years, the LEDs are developed to have features of multi-color (multicolor) and high brightness, so that application fields thereof have been extended to large outdoor billboards, traffic lights and related fields. In the future, the LEDs could even become main illumination light sources having features of power saving and environmental protection.

Generally, a control circuit of the LED first converts an alternating-current (AC) voltage into a direct-current (DC) voltage or a DC current, and then uses the stable DC voltage or the DC current to control a brightness of the LED. In other words, the conventional control circuit of the LED is generally embedded with an AC-DC converter or equipped with a transformer so as to control the LED through an AC commercial power, though in this case, not only a hardware size of the control circuit of the LED is increased, but also application convenience of the LED is limited.

SUMMARY OF THE INVENTION

The invention is directed to an electronic device, which can control load units through alternating-current (AC) commercial power without using an embedded AC/direct-current (DC) converter or a transformer.

The invention is directed to an electronic device, which has advantages of miniaturization and utilization convenience.

The invention provides an electronic device including N load units, (N−1) serial-parallel switch units and a control module, wherein N is an integer greater than 1. The load units respectively have a first terminal and a second terminal, wherein the first terminal of a first load unit is used for receiving an input voltage, and the second terminal of an N-th load unit is coupled to ground.

Moreover, the serial-parallel switch units respectively have a first terminal to a fourth terminal, wherein the first terminal of each of the serial-parallel switch units is used for receiving the input voltage, the second terminal of an i-th serial-parallel switch unit is coupled to the second terminal of an i-th load unit, the third terminal of the i-th serial-parallel switch unit is coupled to the first terminal of an (i+1)-th load unit, and the fourth terminal of each of the serial-parallel switch unit is coupled to ground, wherein i is an integer and $1 \leq i \leq (N-1)$.

Moreover, the control module switches the serial-parallel switch units to a first state or a second state according to a level variation of the input voltage. When the i-th serial-parallel switch unit is in the first state, the first terminal thereof is conducted to the third terminal thereof, and the second terminal thereof is conducted to the fourth terminal thereof, and when the i-th serial-parallel switch unit is in the second state, the both first and the fourth terminals thereof are isolated which are not conducted to any other terminals, and the second terminal thereof is conducted to the third terminal thereof.

The invention provides an electronic device including N first load units, (N−1) first serial-parallel switch units, a second serial-parallel switch unit and a control module, wherein N is an integer greater than 1. The first load units respectively have a first terminal and a second terminal, and the first terminal of a 1st first load unit is used for receiving an input voltage.

Moreover, the first serial-parallel switch units respectively have a first terminal to a fourth terminal, wherein the first terminals of the first serial-parallel switch units are coupled to the first terminal of the 1st first load unit, the second terminal of an i-th first serial-parallel switch unit is coupled to the second terminal of an i-th first load unit, the third terminal of the i-th first serial-parallel switch unit is coupled to the first terminal of an (i+1)-th first load unit, and the fourth terminals of the first serial-parallel switch units are coupled to the second terminal of an N-th first load unit, wherein i is an integer and $1 \leq i \leq (N-1)$.

Moreover, the second serial-parallel switch unit has a first terminal to a fourth terminal. The first terminal of the second serial-parallel switch unit is used for receiving the input voltage, the second terminal of the second serial-parallel switch unit is coupled to the second terminal of the N-th first load unit, and the fourth terminal of the second serial-parallel switch unit is coupled to ground. The control module switches the first serial-parallel switch units and the second serial-parallel switch unit to a first state or a second state according to a level variation of the input voltage. When the i-th first serial-parallel switch unit is in the first state, the first terminal thereof is conducted to the third terminal thereof, and the second terminal is conducted to the fourth terminal thereof, and when the i-th first serial-parallel switch unit is in the second state, the both first and the fourth terminals thereof are isolated which are not conducted to any other terminals, and the second terminal thereof is conducted to the third terminal thereof. When the second serial-parallel switch unit is in the first state, the first terminal thereof is conducted to the third terminal thereof, and the second terminal is conducted to the fourth terminal thereof, and when the second serial-parallel switch unit is in the second state, the both first and the fourth terminals thereof are isolated which are not conducted to any other terminals, and the second terminal thereof is conducted to the third terminals thereof According to the above descriptions, the states of the serial-parallel switch units are switched according to the level variation of the input voltage, so that connection states of the load units are correspondingly changed along with the level variation of the input voltage. In this way, the electronic device can control the load units through AC commercial power without using an embedded AC/DC converter or a transformer. Therefore, compared to the conventional technique, the electronic device of the invention has advantages of miniaturization and utilization convenience.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DETAILED DESCRIPTION OF DISCLOSED EMBODIMENTS

Figure 1:
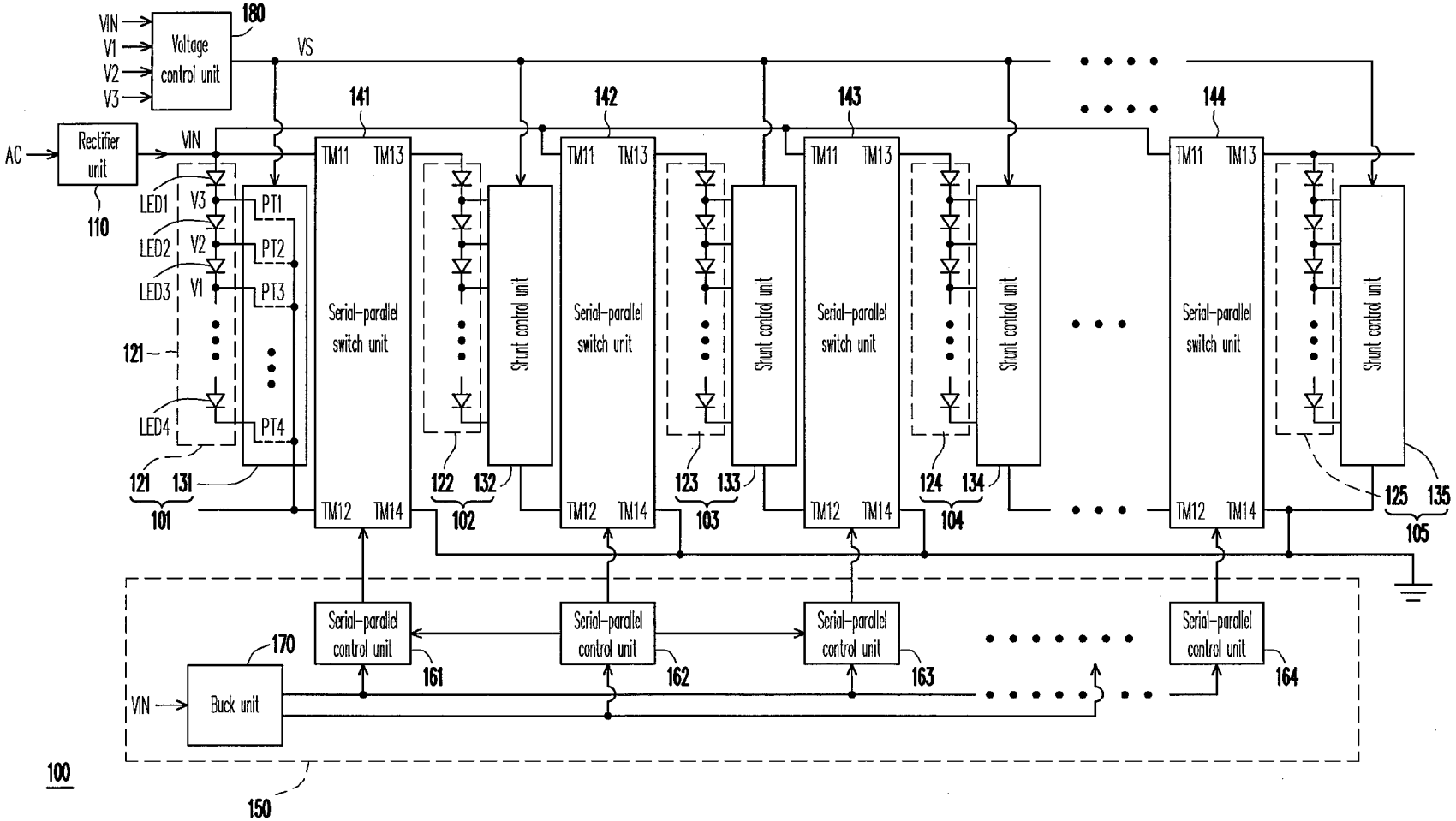
FIG. 1 is a circuit schematic diagram illustrating an illumination device according to an embodiment of the invention.

FIG. 1 is a circuit schematic diagram illustrating an electronic device according to an embodiment of the invention. Referring to FIG. 1, the electronic device 100 includes a rectifier unit 110, N load units 101-105, (N−1) serial-parallel switch units 141-144, and a control module 150, wherein N is an integer greater than 1. The control module 150 includes (N−1) serial-parallel control units 161-164 and a buck unit 170. It should be noticed that the electronic device 100 is an illumination device, in which the load units 101-105 are used to produce light sources. Therefore, in an actual structure, the load units 101-105 respectively include a light emitting diode (LED) string and a shunt control unit, for example, LED strings 121-125 and N shunt control units 131-135. The electronic device 100 further includes a voltage control unit 180, which is used for supplying power required by the shunt control units 131-135 in the load units 101-105.

Referring to FIG. 1, the rectifier unit 110 is used for rectifying an alternating-current (AC) voltage AC, for example, a full-wave rectification. In this way, the rectifier unit 110 outputs an input voltage VIN to the LED string 121. The load unit 101 has a first terminal and a second terminal, and includes the LED string 121 and the shunt control unit 131. The LED string 121 is used for receiving a voltage of the first terminal of the load unit 101. Moreover, the LED string 121 includes M LEDs LED1-LED4, and the LEDs LED1-LED4 are connected in series, wherein M is an integer greater than 1. The shunt control unit 131 is coupled to the LED string 121 and the second terminal of the load unit 101. In view of a whole operation, the shunt control unit 131 may detect a variation of the input voltage VIN varied along with time to obtain a detection result.

Moreover, the shunt control unit 131 provides M shunt paths PT1-PT4 through which the LEDs LED1-LED4 are respectively conducted to the second terminal of the load unit 101. Therefore, the shunt control unit 131 one-by-one turns on the shunt paths PT1-PT4 in a sequence started from the first shunt path PT1 as the input voltage VIN is increased along with time, and the shunt control unit 131 one-by-one turns off the shunt paths PT1-PT4 in a sequence started from the M-th shunt path PT4 as the input voltage VIN is decreased along with time. In this way, during a process that the input voltage VIN is increased along with time, the LEDs LED 1-LED4 are turned on one-by-one, and currents thereof are maintained around a target current. Comparatively, during a process that the input voltage VIN is decreased along with time, the LEDs LED1-LED4 are turned off one-by-one, and currents thereof are still maintained around the target current.

Similarly, the LED strings 122-125 respectively have the same circuit structure as that of the LED string 121. Namely, the LED strings 122-125 respectively have M LEDs connected in series. On the other hand, the shunt control units 132-135 respectively have the same circuit structure as that of the shunt control unit 131. Therefore, the shunt control unit 132 may also control a current of each of the LEDs in the LED string 122 through the M shunt paths. Similarly, the shunt control unit 133 may also control a current of each of the LEDs in the LED string 123 through the M shunt paths. Operation mechanisms of the shunt control units 134 and 135 can be deduced by analogy.

In an actual application, the LED strings 121-125 may respectively have a different number of the LEDs. For example, if the LED string 121 is formed by a plurality of blue LEDs connected in series, and if the LED string 122 is formed by a plurality of red LEDs connected in series, a number NUM1 of the LEDs serially connected in the LED string 121 can be less that a number NUM2 of the LEDs serially connected in the LED string 122, for example, NUM1=⅔ NUM2. In this way, cross-voltages (or optimal operating voltages) of the LED strings 121 and 122 can be relatively close. Moreover, during an actual application, each of the LEDs in the LED strings 121-125 can be constituted by a plurality of LEDs which are combined to serve as one unit, i.e. each of the LEDs LED1-LED4 can be a plurality of LEDs connected in series, parallel, or a combination thereof.

It should be noticed that in the electronic device 100, connection states of the load units 101-105 can be switched by the serial-parallel switch units 141-144. In this way, the electronic device 100 can adjusts a voltage dropped on each of the LED strings 121-125, so that the LED strings 121-125 can be still maintain to the most effectively operating voltage range and operating current range in case of a large variation range of the rectified input voltage VIN.

For example, the serial-parallel switch units 141-144 respectively include a first terminal to a fourth terminal TM11-TM14. The first terminals TM11 of the serial-parallel switch units 141-144 are all used to receive the input voltage VIN, and the fourth terminals TM14 of the serial-parallel switch units 141-144 are all coupled to ground. Moreover, the second terminal TM12 of the serial-parallel switch unit 141 is coupled to the second terminal of the load unit 101, and the third terminal TM13 of the serial-parallel switch unit 141 is coupled to the first terminal of the load unit 102. In addition, the second terminal TM12 of the serial-parallel switch unit 142 is coupled to the second terminal of the load unit 102, and the third terminal TM13 of the serial-parallel switch unit 142 is coupled to the first terminal of the load unit 103. Connection relations of the serial-parallel switch units 143-144 and the load units 103-105 can be deduced by analogy.

In view of a whole operation, when the serial-parallel switch unit 141 is maintained to a first state, the serial-parallel switch unit 141 conducts the first terminal TM11 and the third terminal TM13, and conducts the second terminal TM12 and the fourth terminal TM14. In this way, the load unit 101 is connected to the load unit 102 in parallel. Comparatively, when the serial-parallel switch unit 141 is maintained to a second state, the serial-parallel switch unit 141 isolates the first terminal TM11 and the fourth terminal TM14, but conducts the second terminal TM12 and the third terminal TM13. In this way, the load unit 101 is connected to the load unit 102 in series. On the other hand, the serial-parallel switch units 142-144 respectively have the same circuit structure as that of the serial-parallel switch unit 141, so as to control the connection relations of the load units 102-105.

On the other hand, in the electronic device 100, the buck unit 170 and the serial-parallel control units 161-164 in the control module 150 are used to control the states of the serial-parallel switch units 141-144. Here, the buck unit 170 is used to sense the input voltage VIN, and accordingly produces a plurality of trigger signals with reference of the input voltage VIN. Comparatively, the serial-parallel control units 161-164 control the states of the serial-parallel switch units 141-144 according to the trigger signals, so as to switch the serial-parallel switch units 141-144 to the first state or the second state.

In an actual application, initial states of the serial-parallel switch units 141-144 are maintained to the first state, so that the load units 101-105 are connected in parallel. In other words, when the input voltage VIN is gradually increased, in the beginning, the LED strings 121-125 are connected in parallel. Now, the voltage dropped on each of the LED strings 121-125 is the same, and the shunt control units 131-135 may adjust the currents of the LED strings 121-125, so that each of the LED strings 121-125 may provide a stable light source. However, when an excessively high voltage is dropped on each of the LED strings 121-125, the voltage of the LED strings 121-125 will exceed a predetermined value, and the LED strings 121-125 enter a low efficiency operating range. For avoiding the above-mentioned condition, when the input voltage VIN is increased to a certain voltage value, the serial-parallel switch unit 141-144 of the electronic device 100 may switch the connection relations of the LED strings 121-125.

For example, N=4 is taken as an example, i.e. in case that the electronic device 100 includes four load units 101-104, three serial-parallel switch units 141-143 and three serial-parallel control unit 161-163, in the beginning, the buck unit 170 does not generate the trigger signal. Now, the serial-parallel switch unit 141-144 are maintained in the first state, so that the LED strings 121-124 are connected in parallel.

However, when the input voltage VIN is increased to a certain voltage value, the buck unit 170 outputs a first trigger signal in case that the lowered input voltage VIN complies with a first predetermined voltage (for example, 40V). Now, the serial-parallel control units 161 and 163 switch the serial-parallel switch units 141 and 143 to the second state from the first state according to the first trigger signal. In this way, the LED strings 121 and 122 are connected in series to form a link string, and the LED strings 123 and 124 are connected in series to form another link string. Moreover, the LED strings 122 and 123 are maintained in a parallel connection, i.e. the two link strings are connected in parallel. As the LED strings 121 and 122 are connected in series and the LED strings 123 and 124 are connected in series, the voltage dropped on the LED strings 121-124 is decreased, so that a number of the LEDs lightened in the LED strings 121 and 122 is decreased.

Comparatively, when the input voltage VIN is continually increased to another voltage value, the buck unit 170 outputs a second trigger signal in case that the lowered input voltage VIN complies with a second predetermined voltage (for example, 80V). Now, the serial-parallel control unit 162 switches the serial-parallel switch unit 142 to the second state from the first state according to the second trigger signal, and the serial-parallel control units 161 and 163 are still maintained to a triggered state. In this way, the serial-parallel switch units 141-143 are all maintained to the second state, so that the LED strings 121-124 are connected in series.

In other words, regarding a whole operation mechanism of the electronic device 100, as the input voltage VIN is continually increased, the LED strings 121-125 are connected in series at the beginning, and then every two stings in the LED strings 121-125 are connected in series to form a link string, and the link strings are maintained in a parallel connection. Then, when the input voltage VIN is continually increased to another voltage value, every three strings in the LED strings 121-125 are connected in series to form a link string, and the link strings are maintained in the parallel connection. Deduced by analogy, as the input voltage VIN is continually increased, a number the LED strings connected in series in the link string is gradually increased, and a number of the link strings connected in parallel is gradually decreased until all of the LED strings 121-125 are connected in series.

Comparatively, when the input voltage VIN is decreased along with time, in the beginning, the LED strings 121-125 are connected in series, and then the LED strings 121-125 are divided into two link strings connected in parallel. Then, when the input voltage VIN is continually decreased to another voltage value, the LED strings 121-125 are divided into three link strings connected in parallel. Deduced by analogy, as the input voltage VIN is continually decreased, a number of the link strings connected in parallel is gradually increased, and a number of the LED strings connected in series in the link string is gradually decreased until the LED strings 121-125 are connected in parallel.

In this way, as a level of the AC voltage AC is continually varied, the electronic device 100 can first use the serial-parallel switch units 141-144 to adjust a number of the LED strings 121-125 connected in series, so as to roughly tune a current of each of the LED strings 121-125. Then, the electronic device 100 uses the shunt control units 131-135 to fine-tune a current of each of the LEDs in the LED strings 121-125. In this way, the LED strings 121-125 driven by the AC voltage AC can maintain a stable light source. Comparatively, the electronic device 100 can control the LED strings 121-125 through the AC commercial power without using an embedded AC/DC converter or a transformer, so that the electronic device 100 has advantages of miniaturization and utilization convenience.

It should be noticed that in case that the electronic device 100 is not embedded with the AC/DC converter, the electronic device 100 drives its internal circuits by extracting a plurality of node voltages formed by the LED strings 121-125. For example, the electronic device 100 further includes a voltage control unit 180, and the voltage control unit 180 is coupled to the shunt control units 131-135. The voltage control unit 180 produces a reference voltage according to the input voltage VIN, and extracts a plurality of node voltages formed by the LED strings 121-125, for example, node voltages V1-V3 between the LEDs LED1-LED4 in the LED string 121. In this way, the voltage control unit 180 selects a node voltage from a part of the node voltages greater than the reference voltage to serve as a supply voltage VS, and uses the supply voltage VS to drive the corresponding shunt control units 131-135. In this way, power consumption of the electronic device 100 can be effectively reduced.

To fully convey the spirit of the invention to those skilled in the art, internal circuit structures of the shunt control unit 131, the serial-parallel switch unit 141 and the voltage control unit 180 are further described below.

Figure 2:
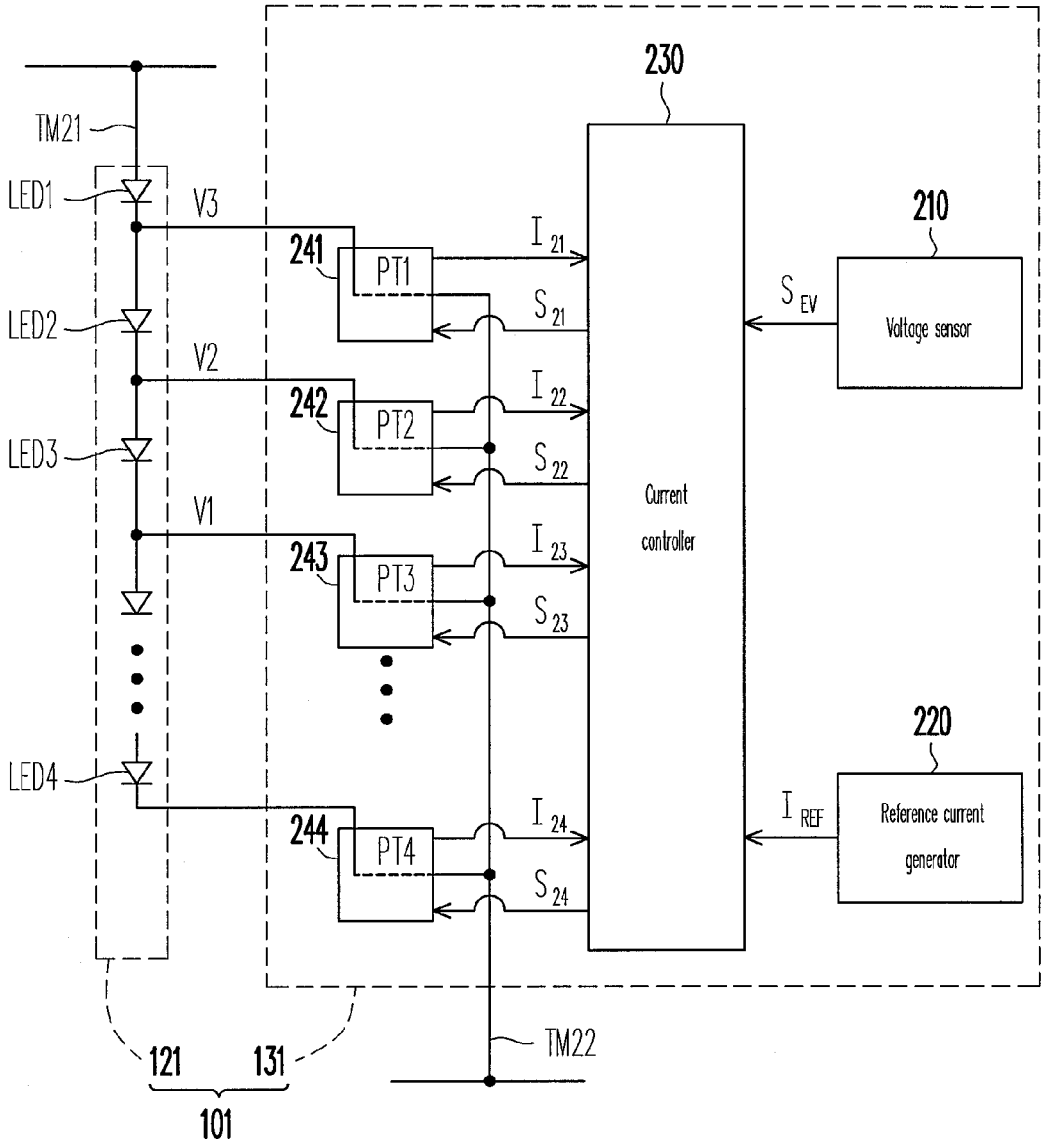
FIG. 2 is a circuit block diagram illustrating a shunt control unit according to an embodiment of the invention.

FIG. 2 is a circuit block diagram illustrating a shunt control unit according to an embodiment of the invention. In FIG. 2, the LED string 121 is further illustrated, and two terminals TM21 and TM22 of the load unit 101 are indicated. Referring to FIG. 2, the shunt control unit 131 includes a voltage sensor 210, a reference current generator 220, a current controller 230 and M current controllers 241-244. In view of the whole structure, the current controllers 241-244 are coupled to the LEDs LED1-LED4 in the LED string 121 for providing the shunt paths PT1-PT4 through which the LEDs LED1-LED4 are conducted to the second terminal TM22 of the load unit 101. The current controller 230 is coupled to the voltage sensor 210, the reference current generator 220 and the current controllers 241-244.

In view of the whole operation, the voltage sensor 210 is used for sensing a variation of the input voltage VIN varied along with time, and produces a corresponding sensing voltage variation signal $S_{EV}$. The reference current generator 220 is used to generate a reference current signal $I_{REF}$. The current controller 241 is used for detecting a current flowing through the shunt path PT1, i.e. a current difference between the LEDs LED1 and LED2 in the LED string 121. Similarly, the current controllers 242-244 respectively detect currents flowing through the shunt paths PT2-PT4. The current controllers 241-244 further generate corresponding sensing current signals $I_{21}$-$I_{24}$ to the current controller 230. The sensing current signals $I_{21}$-$I_{24}$ can be converted into corresponding analog voltages or digital signals for providing to the current controller 230.

Now, the current controller 230 may obtain a current of the LED LED1 by accumulating the sensing current signals $I_{21}$-$I_{24}$, and obtain a current of the LED LED2 by accumulating the sensing current signals $I_{22}$-$I_{24}$. Deduced by analogy, the current controller 230 obtains the current information of the LEDs LED1-LED4 according to the sensing current signals $I_{21}$-$I_{24}$. Moreover, the current controller 230 multiplies the reference current signal $I_{REF}$ by a predetermined multiple to generate a target current signal. In this way, the current controller 230 compares the target current signal with the sensing current signals $I_{21}$-$I_{24}$, and limits the currents flowing through the shunt paths PT1-PT4 to be lower than a target current through shunt control signals $S_{21}$-$S_{24}$. It should be noticed that during the operation of limiting the currents flowing through the shunt paths PT1-PT4, the current controller 230 can precisely control the shunt paths PT1-PT4 with reference of the sensing voltage variation signal $S_{EV}$ generated by the voltage sensor 210, though the invention is not limited thereto, and those skilled in the art can determine whether the voltage sensor 210 is used according to an actual design requirement.

Regarding detailed operations of the shunt paths PT1-PT4, when the input voltage VIN is increased from the lowest value to a value that is great enough to light the LED LED1 but is not enough to simultaneously light the LEDs LED1 and LED2, the current flowing through the shunt path PT1 is gradually increased from "0" to the target current. When the input voltage VIN is increased to a value that is great enough to simultaneously light the LEDs LED1 and LED2 but is not enough to simultaneously light the LEDs LED1-LED3, the current flowing through the shunt path PT2 is gradually increased from "0". When the current controller 230 detects the sensing current signal $I_{22}$, the current controller 230 adjusts the current flowing through the shunt path PT1 through the shunt control signal $S_{21}$, so as to maintain the current flowing through the LED LED1 around the target current. Now, the current flowing through the LED LED1 is equivalent to the current flowing through the shunt path PT1 plus the current flowing through the shunt path PT2.

The current controller 230 simultaneously controls the current flowing through the shunt path PT2 through the shunt control signal $S_{22}$, so that the current flowing through the shunt path PT2 is not higher than the target current. Similarly, when the current controller 230 detects the sensing current signal $I_{23}$, the current controller 230 adjusts the current flowing through the shunt paths PT1 and PT2 through the shunt control signals $S_{21}$ and $S_{22}$, so as to maintain the currents flowing through the LEDs LED1 and LED2 around the target current, and control the current flowing through the shunt path PT3 to be not higher than the target current. Now, the current flowing through the LED LED2 is equivalent to the current flowing through the shunt path PT2 plus the current flowing through the shunt path PT3. Operation mechanisms of the current controllers 243-244 can be deduced by analogy. In this way, the LED string 121 can be maintained to operate around the target current, and light up a maximum number of the LEDs "capable of being lighted up" according to the input voltage VIN.

Figure 3:
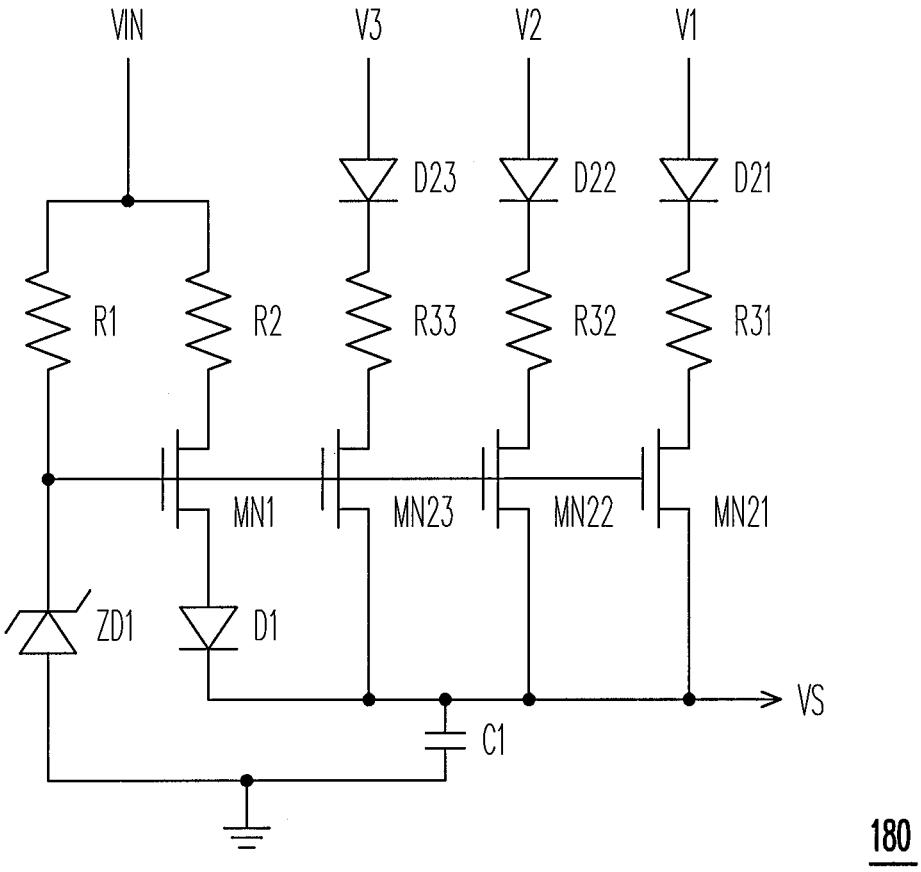
FIG. 3 is a circuit schematic diagram illustrating a voltage control unit according to an embodiment of the invention.

FIG. 3 is a circuit schematic diagram illustrating a voltage control unit according to an embodiment of the invention. Referring to FIG. 3, the voltage control unit 180 includes resistors R1 and R2, resistors R31-R33, a Zener diode ZD1, N-type transistors MN1 and MN21-MN23, diodes D1 and D21-D24, and a capacitor C1. It is assumed that the voltage control unit 180 extracts the node voltages V1-V3 formed by the LED string 121 to generate the supply voltage VS, wherein V1<V2<V3.

Referring to FIG. 3, first ends of the resistors R1 and R2 receive the input voltage VIN. A cathode of the Zener diode ZD1 is coupled to a second end of the resistor R1, and an anode thereof is coupled to ground. A first terminal of the N-type transistor MN1 is coupled to a second end of the resistor R2, and a control terminal thereof is coupled to the cathode of the Zener diode ZD1. An anode of the diode D1 is coupled to a second terminal of the N-type transistor MN1, and a cathode thereof is used for generating the supply voltage VS. A first end of the capacitor C1 is coupled to the cathode of the anode D1, and a second end thereof is coupled to ground.

On the other hand, anodes of the diodes D21-D23 respectively receive the node voltages V1-V3, and first ends of the resistors R31-R33 are respectively coupled to cathodes of the diodes D21-D23. Moreover, a first terminal of the N-type transistor MN21 is coupled to a second end of the resistor R31, a control terminal of the N-type transistor MN21 is coupled to the cathode of the Zener diode ZD1, and a second terminal thereof is coupled to the first end of the capacitor C1. A first terminal of the N-type transistor MN22 is coupled to a second end of the resistor R32, a control terminal of the N-type transistor MN22 is coupled to the cathode of the Zener diode ZD1, and a second terminal thereof is coupled to the first end of the capacitor C1. A first terminal of the N-type transistor MN23 is coupled to a second end of the resistor R33, a control terminal of the N-type transistor MN23 is coupled to the cathode of the Zener diode ZD1, and a second terminal thereof is coupled to the first end of the capacitor C1.

In view of a whole operation, the voltage control unit 180 maintains a voltage of the control terminals of the N-type transistors MN21-MN23 to a specific voltage (for example, 5.7V) through the resistor R1 and the Zener diode ZD1. In this way, a current loop formed by the resistor R2, the N-type transistor MN1, the diode D1 and the capacitor C1 can immediately produce a primary supply voltage VS according to the reference voltage in case that the input voltage VIN is excessively low and the N-type transistors MN21-MN23 cannot effectively supply power to the C1 to establish the supply voltage VS, and accordingly provide the primary supply voltage VS to the shunt control units 131-135 for utilization. Since the diode D1 can provide a voltage difference of 0.6-0.7V, such power supply path with poor energy efficiency can be cut off when any of the N-type transistors is activated.

Moreover, it should be noticed that in the voltage control unit 180, layout areas of the N-type transistor MN21-MN23 are sequentially decreased, and resistances of the resistors R31-R33 are sequentially increased. Therefore, in case that the node voltages V1-V3 are all greater than the reference voltage, a current loop formed by the diode D21, the resistor R31 and the N-type transistor MN21 becomes a main power source. It is known that levels of the node voltages V1-V3 are sequentially increased, i.e. V1<V2<V3, so that the voltage control unit 180 first selects the node voltage V1 with the lowest level to serve as the supply voltage VS. In other words, in case that the input voltage VIN and the node voltages V1-V3 are all varied, the voltage control unit 180 selects a node voltage closest to and greater than the reference voltage from the node voltages V1-V3 to serve as the supply voltage VS, i.e. selects a path of lowest power consumption to supply power.

Figure 4:
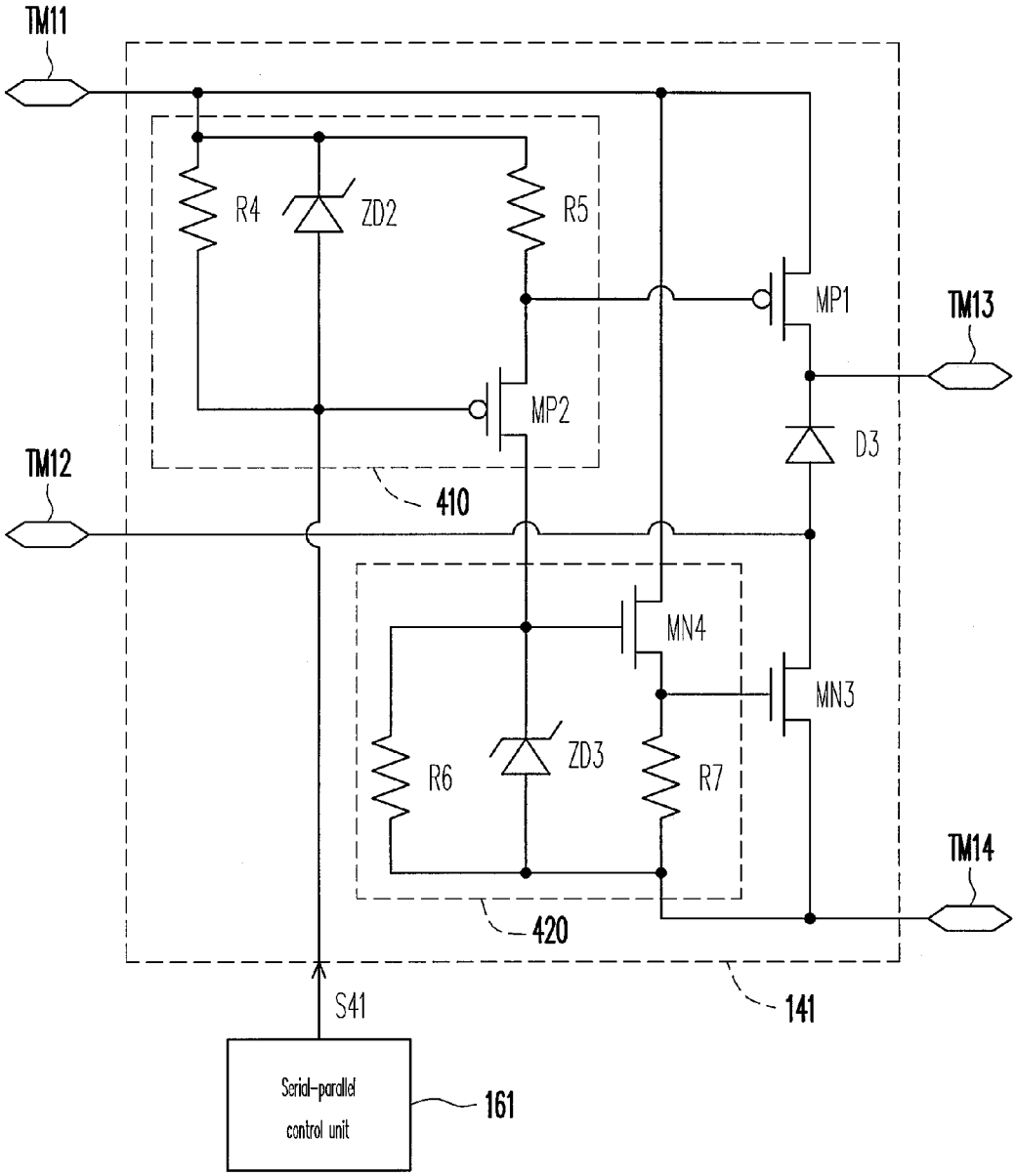
FIG. 4 is a circuit schematic diagram illustrating a serial-parallel switch unit according to an embodiment of the invention.

FIG. 4 is a circuit schematic diagram illustrating a serial-parallel switch unit according to an embodiment of the invention. Referring to FIG. 4, the serial-parallel switch unit 141 includes a P-type transistor MP1, a diode D3, a N-type transistor MN3, a first potential control unit 410 and a second potential control unit 420. The first potential control unit 410 includes resistors R4 and R5, a Zener diode ZD2 and a P-type transistor MP2. The second potential control unit 420 includes resistors R6 and R7, a Zener diode ZD3 and a N-type transistor MN4. The serial-parallel switch unit 141 is controlled by a switch signal S41 generated by the serial-parallel control unit 161.

As shown in FIG. 4, a first end of the resistor R4 is coupled to the first terminal TM11 of the serial-parallel switch unit 141. The Zener diode ZD2 and the resistor R4 are connected in parallel to protect the P-type transistor MP2. A first end of the resistor R5 is coupled to the first end of the resistor R4. A first terminal of the P-type transistor MP2 is coupled to a second end of the resistor R5, and a control terminal of the P-type transistor MP2 is coupled to a second end of the resistor R4 and is used for receiving the switch signal S41 from the serial-parallel control unit 161. On the other hand, a first end of the resistor R6 is coupled to a second terminal of the P-type transistor MP2, and a second end thereof is coupled to the fourth terminal TM14 of the serial-parallel switch unit 141. The Zener diode ZD3 and the resistor R6 are connected in parallel for protecting the N-type transistor MN4. A first terminal of the N-type transistor MN4 is coupled to the first terminal TM11 of the serial-parallel switch unit 141, and a control terminal thereof is coupled to the first end of the resistor R6. A first end of the resistor R7 is coupled to a second terminal of the N-type transistor MN4, and a second end thereof is coupled to the second end of the resistor R6.

On the other hand, a first terminal of the P-type transistor MP1 is coupled to the first terminal TM11 of the serial-parallel switch unit 141, a control terminal thereof is coupled to the second end of the resistor R5, and a second terminal thereof is coupled to the third terminal TM13 of the serial-parallel switch unit 141. A cathode of the diode D3 is coupled to the second terminal of the P-type transistor MP1, and an anode thereof is coupled to the second terminal TM12 of the serial-parallel switch unit 141. A first terminal of the N-type transistor MN3 is coupled to the anode of the diode D3, a control terminal thereof is coupled to the first end of the resistor R7, and a second terminal thereof is coupled to the fourth terminal TM14 of the serial-parallel switch unit 141.

In view of a whole operation, as a level of the switch signal S41 is switched, the first potential control unit 410 and the second potential control unit 420 synchronously operate, so that the serial-parallel switch unit 141 is switched to the first state or the second state. When the serial-parallel switch unit 141 is maintained in the first state, the P-type transistor MP1 and the N-type transistor MN3 are maintained in a conducting state, so that the first terminal TM11 and the third terminal TM13 of the serial-parallel switch unit 141 are electrically connected, and the second terminal TM12 and the fourth terminal TM14 of the serial-parallel switch unit 141 are electrically connected. Comparatively, when the serial-parallel switch unit 141 is maintained in the second state, the P-type transistor MP1 and the N-type transistor MN3 are maintained in a non-conducting state, and the diode D3 is conducted. Now, the second terminal TM12 and the third terminal TM13 of the serial-parallel switch unit 141 are electrically connected, and the first terminal TM11 and the fourth terminal TM14 of the serial-parallel switch unit 141 are not electrically connected. Now, the load unit 101 connected to the second terminal TM12 of the serial-parallel switch unit 141 and the load unit 102 connected to the third terminal TM13 of the serial-parallel switch unit 141 are connected in series.

Figure 5:
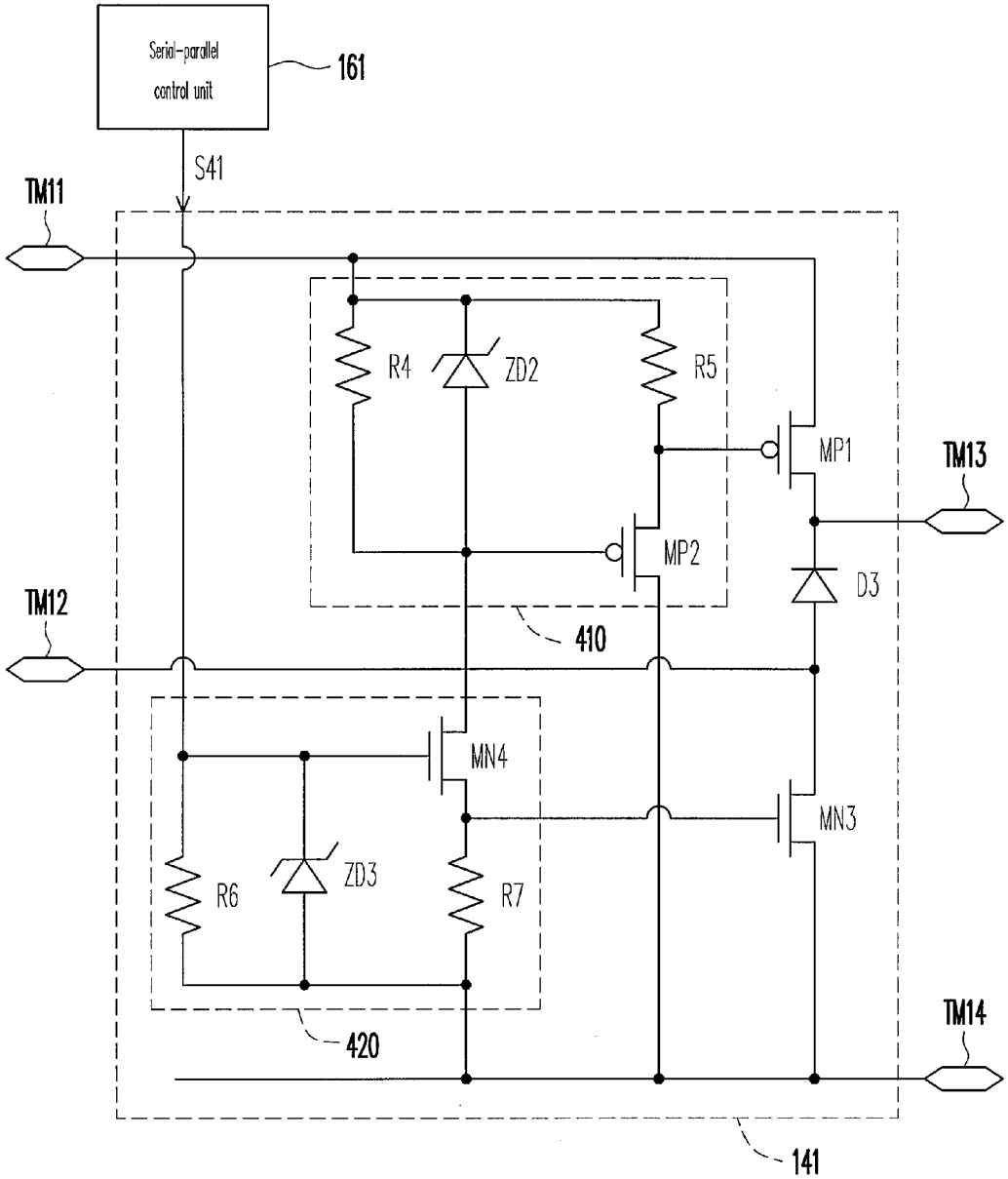
FIG. 5 is a circuit schematic diagram illustrating a serial-parallel switch unit according to another embodiment of the invention.

It should be noticed that the serial-parallel switch unit 141 of FIG. 4 uses the switch signal S41 to control the first potential control unit 410, and then the first potential control unit 410 drives the second potential control unit 420, so the first potential control unit 410 and the second potential control unit 420 can synchronously operate. However, in an actual application, as shown in FIG. 5, the serial-parallel switch unit can use the switch signal S41 to control the second potential control unit 420, and then the second potential control unit 420 drives the first potential control unit 410, so as to achieve the synchronous operation of the first potential control unit 410 and the second potential control unit 420. Different to the serial-parallel switch unit 141 of FIG. 4, in the serial-parallel switch unit 141 of FIG. 5, the second potential control unit 420 receives the switch signal S41 through the control terminal of the N-type transistor MN4, and the first potential control unit 410 is coupled to the fourth terminal TM14 of the serial-parallel switch unit 141 through the second terminal of the P-type transistor MP2. Moreover, the second potential control unit 420 is coupled to the control terminal of the P-type transistor MP2 in the first potential control unit 410 through the first terminal of the N-type transistor MN4. It should be noticed that the diode D3 shown in FIG. 5 can also be implemented by an equivalent circuit with a unidirectional conduction effect or a bi-directional conduction effect. The first potential control unit 410 and the second potential control unit 420 can also be implemented by other control circuits.

Figure 6:
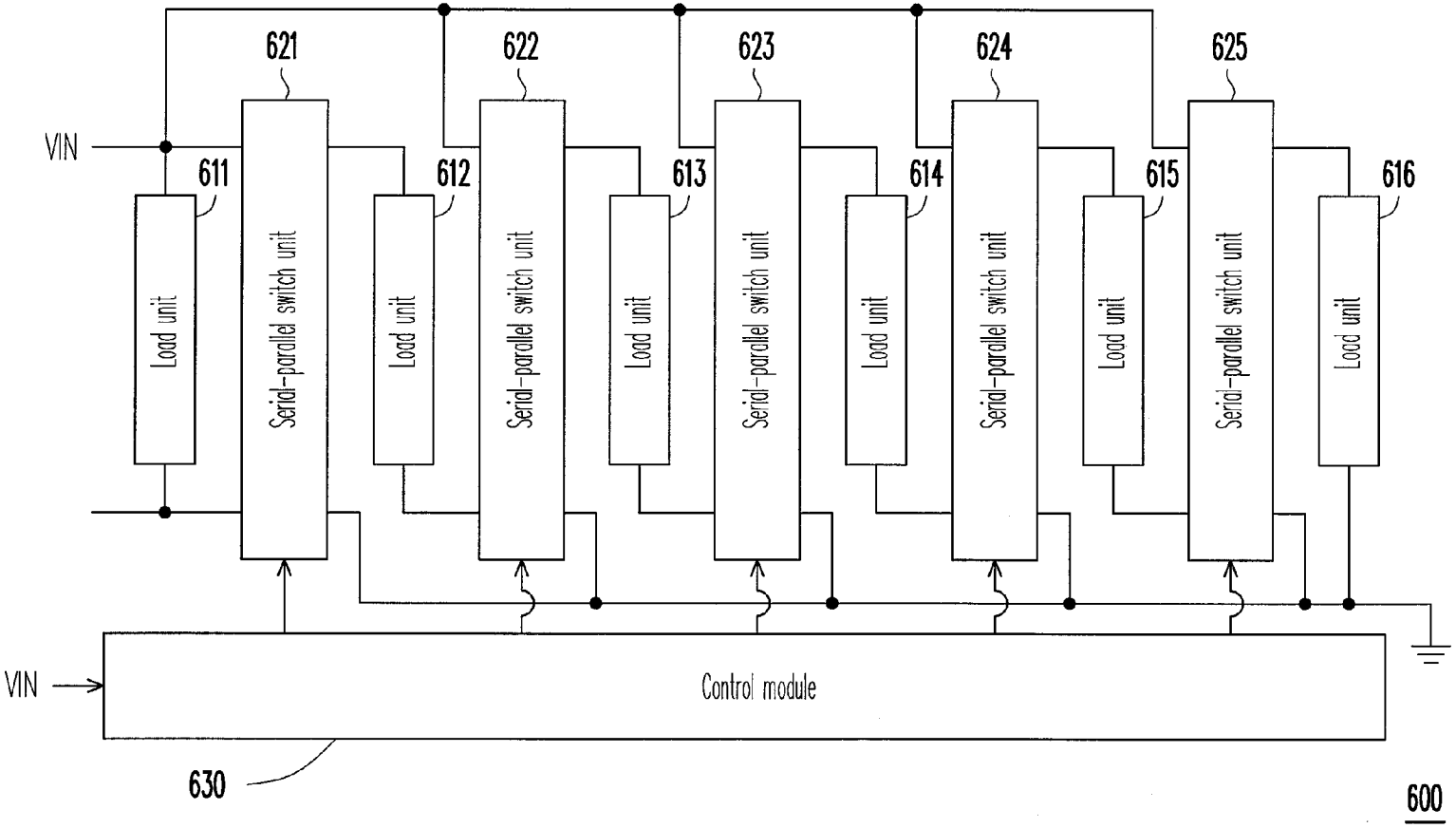
FIG. 6 is a circuit schematic diagram illustrating an electronic device according to another embodiment of the invention.

FIG. 6 is a circuit schematic diagram illustrating an electronic device according to another embodiment of the invention. Referring to FIG. 6, the electronic device 600 includes a plurality of load units 611-616, a plurality of serial-parallel switch units 621-625, and a control module 630. Similar to the embodiment of FIG. 1, the electronic device 600 can use the control module 630 to control states of the serial-parallel switch units 621-625, so as to switch connection relations of the load units 611-616.

Figure 7A:
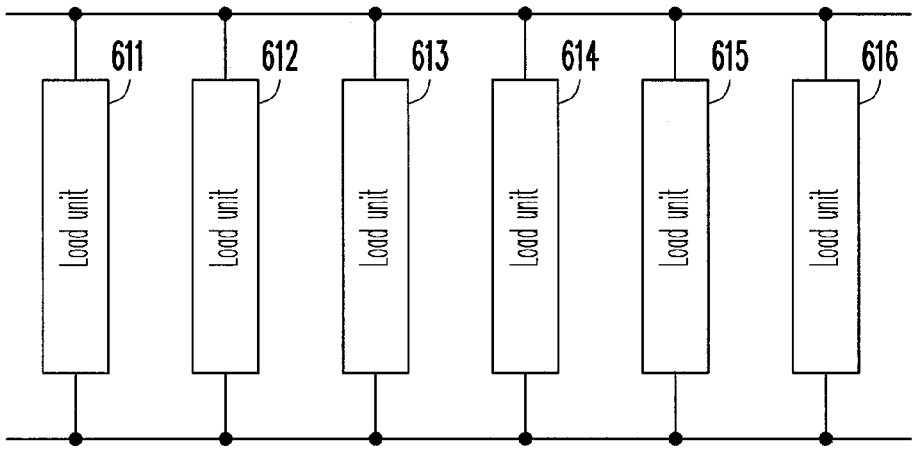
FIGS. 7A-7D are circuit schematic diagrams illustrating connection relations of the load units of FIG. 6.
Figure 7B:
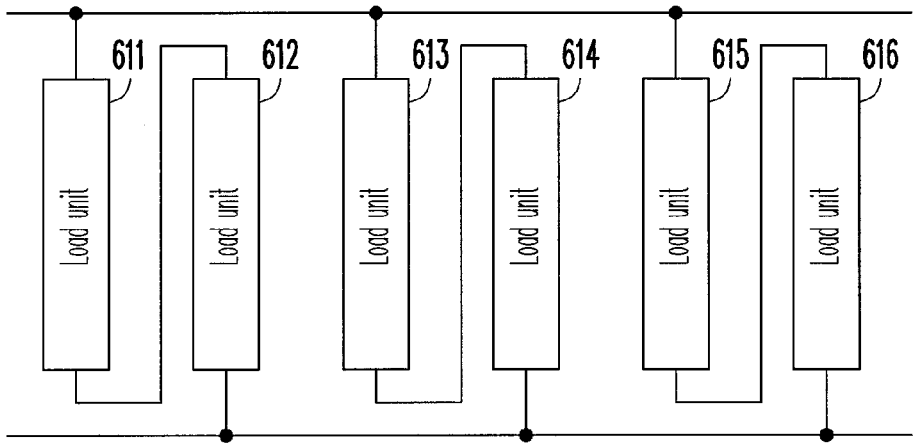
Figure 7C:
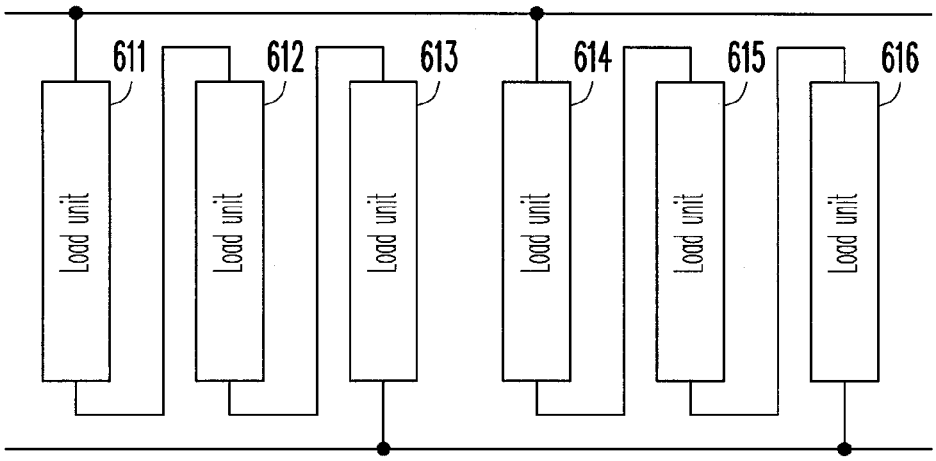
Figure 7D:
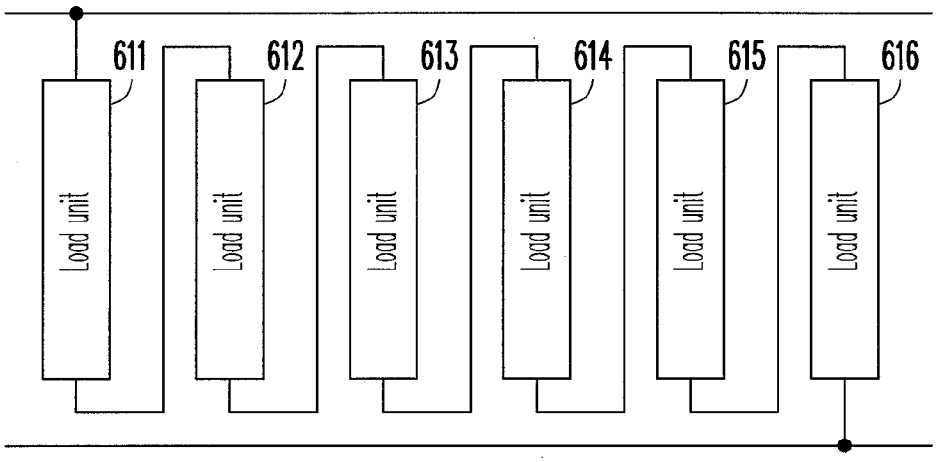

In the embodiment of FIG. 6, as the connection relation of the load units 611-616 is varied, different serial-parallel connection effects can be achieved. For example, shown in a table 1 and FIGS. 7A-7D, when the serial-parallel switch units 621-625 are all in a first state (a parallel state), an effect that the load units 611-616 are all connected in parallel as that shown in FIG. 7A is obtained. When the serial-parallel switch units 621, 623 and 625 are all in a second state (a serial state), and the serial-parallel switch units 622 and 624 are all in the first state (the parallel state), an effect that every two of the load units 611-616 are connected in series as that shown in FIG. 7B is obtained. When the serial-parallel switch units 621, 622, 624 and 625 are all in the second state (the serial state), and the serial-parallel switch unit 623 is in the first state (the parallel state), an effect that every three of the load units 611-616 are connected in series as that shown in FIG. 7C is obtained. When the serial-parallel switch units 621-625 are all in the second state (the serial state), an effect that the load units 611-616 are all connected in series as that shown in FIG. 7D is obtained.

TABLE 1

| | Serial-parallel switch unit 621 | Serial-parallel switch unit 622 | Serial-parallel switch unit 623 | Serial-parallel switch unit 624 | Serial-parallel switch unit 625 |
|---|---|---|---|---|---|
| 1 | Parallel state | Parallel state | Parallel state | Parallel state | Parallel state |
| 2 | Serial state | Parallel state | Serial state | Parallel state | Serial state |
| 3 | Serial state | Serial state | Parallel state | Serial state | Serial state |
| 4 | Serial state | Serial state | Serial state | Serial state | Serial state |

Moreover, a main difference between the embodiments of FIG. 6 and FIG. 1 is that the load units 611-616 may respectively include a resistor, a capacitor, an inductor, a diode, a bipolar transistor, a field effect transistor, a light emitting diode, a laser diode, a photo sensor, a signal receiver, a signal transmitter, a battery, a DC power supply, or a combination thereof. Therefore, as the components of the load units 611-616 are different, one or a plurality of the load units 611-616 can be used to store energy, so as to provide power to the LEDs when external power is inadequate.

Moreover, one or a plurality of the load units 611-616 can be used for receiving external cable or wireless signals, so as to adjust a reference current value within the control module to a achieve an effect of adjusting a light emitting brightness or chrominance (color). Moreover, one or a plurality of the load units 611-616 can be used for sending signals to other external control systems, or used for controlling the other LED strings. Moreover, one or a plurality of the load units 611-616 can be used as a stable power supply for supplying power to other system for utilization.

It should be noticed that when the load units 611-616 do not require an additional supply voltage, configuration of the voltage control unit 180 of FIG. 1 in the electronic device 600 is unnecessary. Moreover, the rectifier unit 110 of FIG. 1 can also be disposed at an external circuit according to a design requirement, so that the rectifier unit can be selectively configured in the electronic device 600. Detailed circuit structures and operation principles of the components in the electronic device 600 have been described in the aforementioned embodiment, so that detailed descriptions thereof are not repeated.

Further, the first terminals of the serial-parallel switch units of FIG. 1 and FIG. 6 are all coupled to the input voltage VIN, i.e. the highest voltage, and the fourth terminals of the serial-parallel switch units are all coupled to ground, i.e. the lowest voltage. However, in an actual application, the serial-parallel switch units and the load units can be coupled according to another approach to achieve the similar switching operation.

Figure 8:
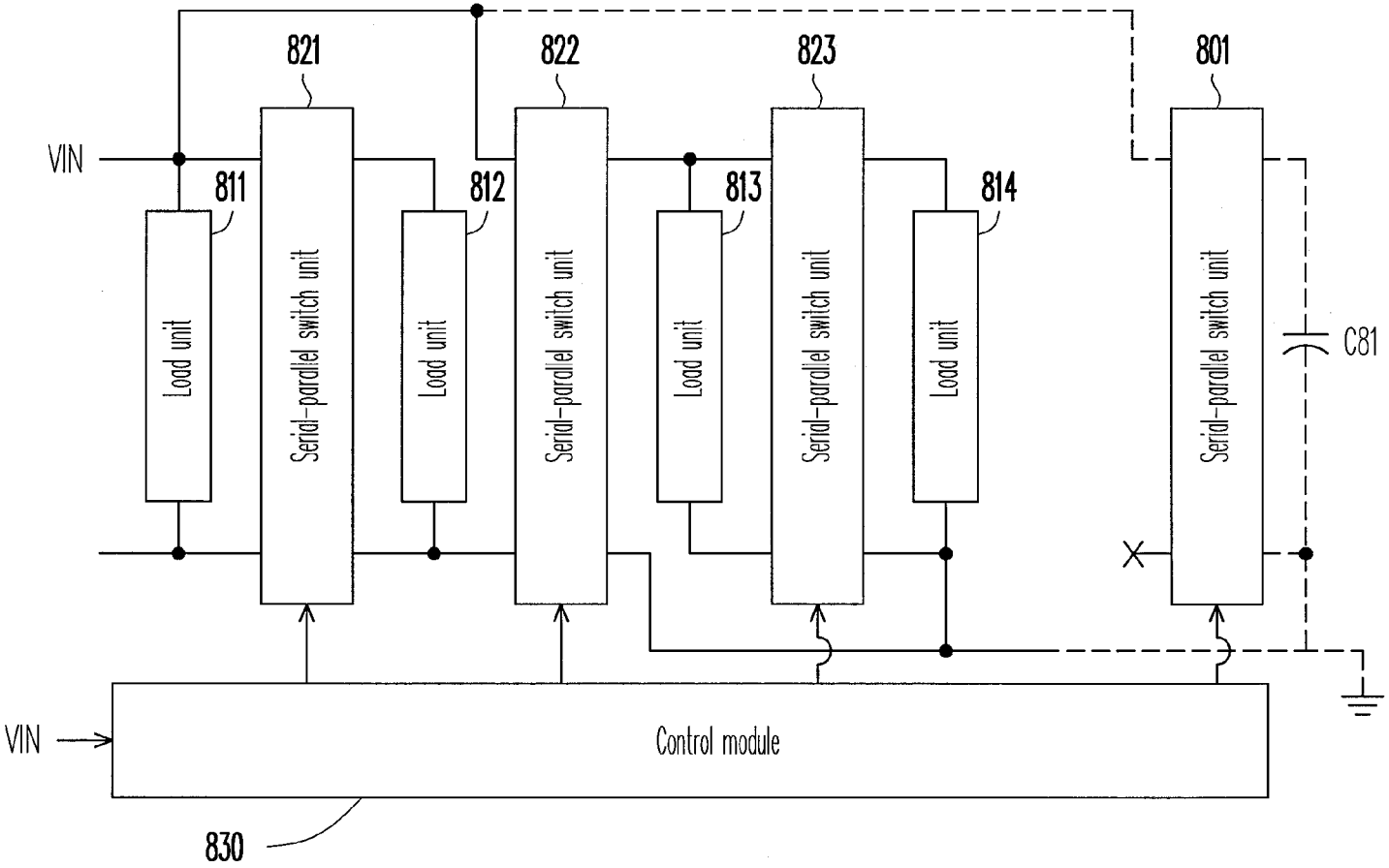
FIG. 8 is a circuit schematic diagram illustrating an electronic device according to still another embodiment of the invention.

For example, FIG. 8 is a circuit schematic diagram illustrating an electronic device according to still another embodiment of the invention. The electronic device 800 includes a plurality of load units 811-814, a plurality of serial-parallel switch units 821-823 and a control module 830. A main difference between the embodiment of FIG. 8 and the embodiments of FIG. 1 and FIG. 6 is that in the embodiment of FIG. 8, the load units 811-812 and the serial-parallel switch unit 821 are regarded as a whole unit, and the load units 813-814 and the serial-parallel switch unit 823 are regarded as another whole unit, and a serial-parallel connection between the two whole units is controlled by the serial-parallel switch unit 822. Moreover, regarding detailed connection relations, the fourth terminal of the serial-parallel switch unit 821 is coupled to the second terminal of the load unit 812, and the fourth terminal of the serial-parallel switch unit 823 is coupled to the second terminal of the load unit 814.

Figure 9A:
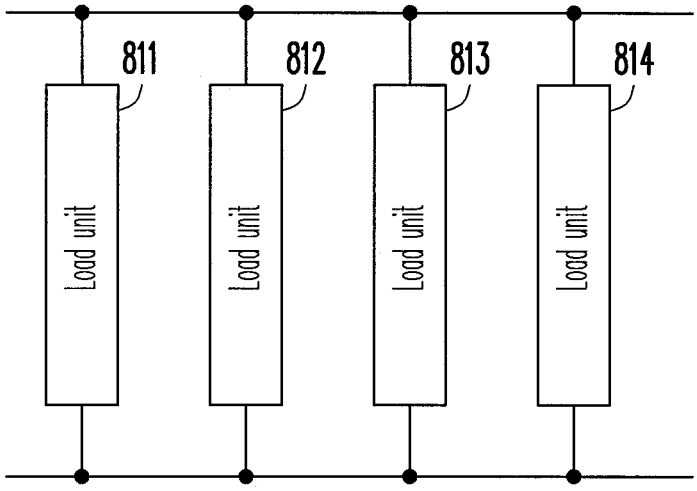
FIGS. 9A-9C are circuit schematic diagrams illustrating connection relations of the load units of FIG. 8.
Figure 9B:
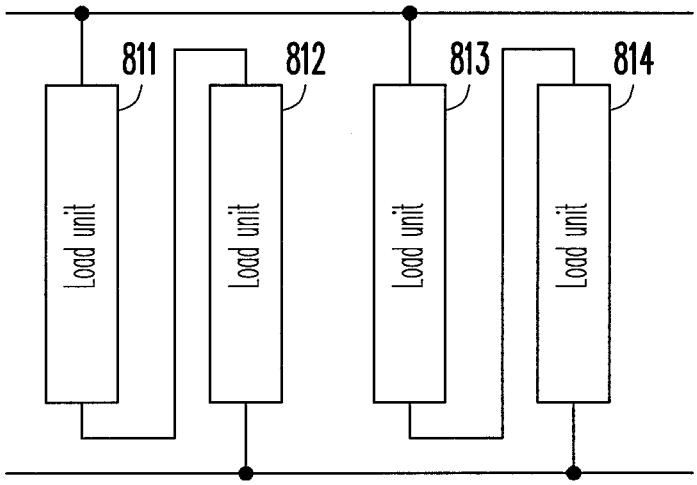
Figure 9C:
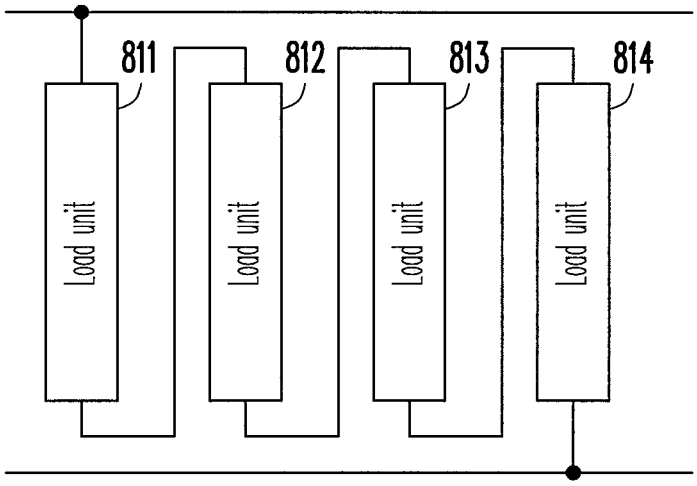

Moreover, similar to the embodiments of FIG. 1 and FIG. 6, the electronic device 800 can use the control module 830 to control the states of the serial-parallel switch units 821-823, so as to switch the connection relations of the load units 811-814. For example, in the embodiment of FIG. 8, as shown in a table 2 and FIGS. 9A-9C, when the serial-parallel switch units 821-823 are all in a first state (a parallel state), an effect that the load units 811-814 are all connected in parallel as that shown in FIG. 9A is obtained. When the serial-parallel switch units 821 and 823 are all in a second state (a serial state), and the serial-parallel switch unit 822 is in the first state (the parallel state), an effect that every two of the load units 811-814 are connected in series as that shown in FIG. 9B is obtained. When the serial-parallel switch units 821-823 are all in the second state (the serial state), an effect that the load units 811-814 are all connected in series as that shown in FIG. 9C is obtained.

TABLE 2

| | Serial-parallel switch unit 821 | Serial-parallel switch unit 822 | Serial-parallel switch unit 823 |
|---|---|---|---|
| 1 | Parallel state | Parallel state | Parallel state |
| 2 | Serial state | Parallel state | Serial state |
| 3 | Serial state | Serial state | Serial state |

Moreover, the load units 811-814 shown in FIG. 8 may respectively include different passive devices, active devices, or a combination of the passive devices or the active devices. In addition, a rectifier unit and a voltage control unit can also be selectively configured in the electronic device 800 according to a design requirement. Detailed circuit structures and operation principles of the components in the electronic device 800 have been described in the aforementioned embodiment, so that detailed descriptions thereof are not repeated.

It should be noticed that regardless whether the coupling method of the serial-parallel switch units and the load units of FIG. 1 and FIG. 6 is used, or the coupling method of FIG. 8 is used, a serial-parallel switch unit and a capacitor can be added to further increase a performance of the electronic device.

For example, it is assumed that a serial-parallel switch unit 801 and a capacitor C81 are added to the electronic device 800 of FIG. 8, and the load units 811-814 have the same circuit structure as that of the load units 101-105 of FIG. 1, i.e. the load units 811-814 respectively include a LED string and a shunt control unit, and the electronic device 800 is additional configured with a voltage control unit to provide a voltage source required by the shunt control units of the load units 811-814. Moreover, it is further assumed that an operating voltage of the LED strings in the load units 811-814 is more than 12V, and is preferably between 20V and 40V to achieve an optimal operating efficiency.

In this case, at the beginning, the load units 811-814 are all connected in parallel. Then, during a process that the input voltage VIN is increased from 0V to 12V for the first time, the input voltage VIN cannot light the LED strings in the load units 811-814, but the input voltage VIN can continually charge the capacitor C81, so that the capacitor C81 may have an electricity quantity of 12V. When the input voltage VIN reaches 12V for the first time and is lower than 20V, the LED strings in the load units 811-814 are lightened, though the LED strings are not in the optimal voltage operating range, and now the electricity quantity stored in the capacitor C81 is gradually increased to 20V. When the input voltage VIN reaches 20V for the first time and is lower than 40V, the LED strings in the load units 811-814 are in the optimal voltage operating range, and the electricity quantity stored in the capacitor C81 is gradually increased to 40V.

When the input voltage VIN reaches 40V for the first time and is lower than 80V, the serial-parallel switch units 821, 823 and 801 are switched to the second state (the serial state), and now the LED strings in the load units 811-814 are changed to a connection state that every two of the LED strings connected in series, and a cross-voltage of each of the LED strings is ½ of the input voltage VIN. Now, the cross-voltage of each of the LED strings is gradually increased from 20V (a half of 40V) to 40V (a half of 80V), so that the LED strings are still in the optimal voltage operating range, though the capacitor C81 is isolated from external, and is maintained to 40V.

When the input voltage VIN reaches 80V, the serial-parallel switch units 821~823 and 801 are all switched to the second state (the serial state), and the LED strings are all connected in series, and a cross-voltage of each of the LED strings is ¼ of the input voltage VIN. Now, the cross-voltage of each of the LED strings is between 20V (¼ of 80V) and 39V (¼ of a highest voltage 155 obtained after the 110V AC voltage is rectified), so that the LED strings are still in the optimal voltage operating range. Moreover, the capacitor C81 is still isolated from external, and is maintained to 40V.

When the input voltage VIN is decreased to be lower than 80V but higher than 40V, the serial-parallel switch unit 822 is switched to the first state (the parallel state), and now the LED strings are changed back to the connection state that every two of the LED strings are connected in series, and the respective cross-voltage is changed back to ½ of the input voltage VIN. Now, the cross-voltage of each of the LED strings is between 20V and 40V, so that the LED strings are still in the optimal voltage operating range. Moreover, the capacitor C81 is still isolated from external, and is maintained to 40V.

When the input voltage VIN is decreased to be lower than 40V, the serial-parallel switch units 821-823 are all switched to the first state (the parallel state), and now the LED stings are connected in parallel, and are connected to the capacitor C81 in parallel. Now, the input voltage VIN is lower than the voltage of the capacitor C81, so that the capacitor C81 replaces the input voltage VIN to become the power source for the LED strings. Here, as long as the capacitance of the capacitor C81 is enough, it can maintain the LED strings in the optimal voltage operating range (>20V) until a next voltage increasing cycle for more than 20V. In this way, the LED strings can be maintained in a light up state, so as to eliminate a flicking problem of the light source.

It should be noticed that in the electronic device 800 of FIG. 8, two load units and one serial-parallel switch unit are regarded as a whole unit, and another serial-parallel switch unit is used to switch the serial-parallel connection of the whole structure. However, in the actual application, those skilled in the art can extend the whole structure of FIG. 8 to a plurality of load units and a plurality of serial-parallel switch units.

Figure 10:
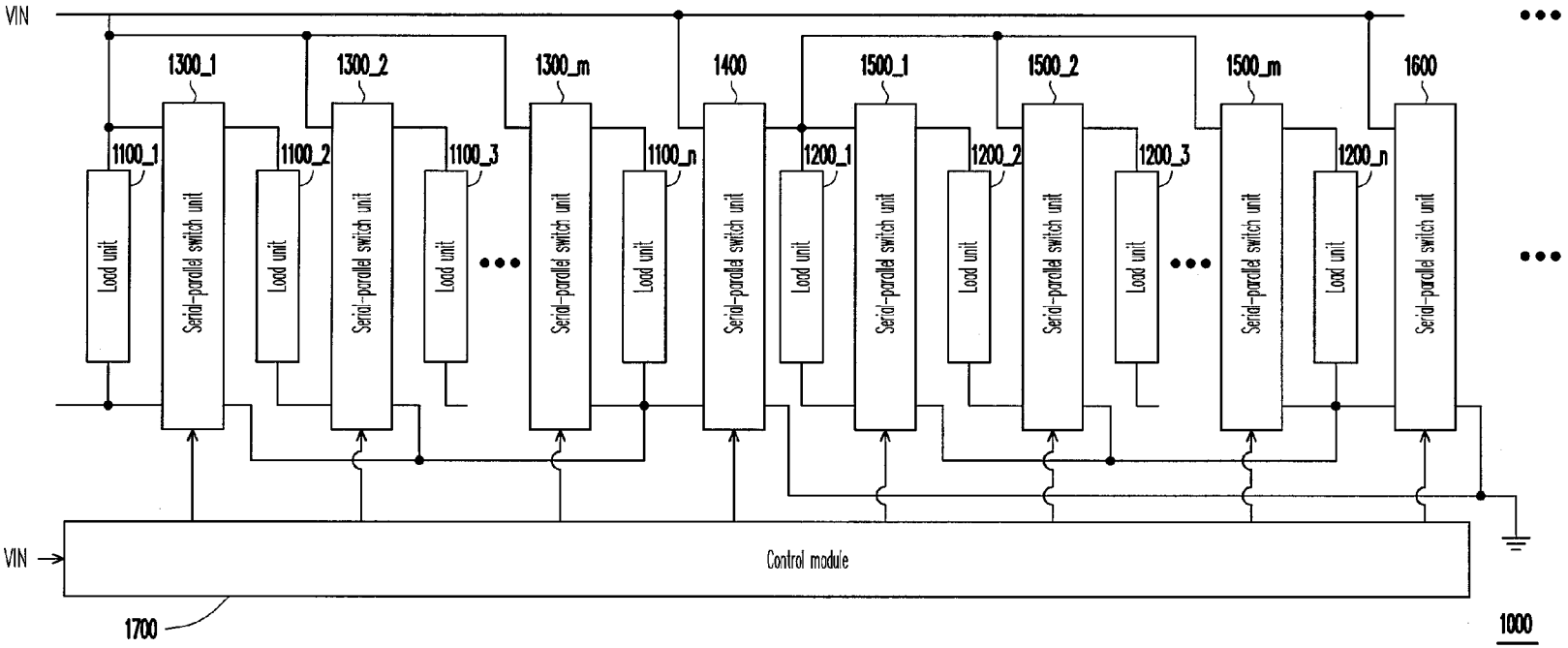
FIG. 10 is a circuit schematic diagram illustrating an electronic device according to yet another embodiment of the invention.

For example, FIG. 10 is a circuit schematic diagram illustrating an electronic device according to yet another embodiment of the invention. The electronic device 1000 includes a plurality of load units 1100_1-1100_*n* and 1200_1-1200_*n*, a plurality of serial-parallel switch units 1300_1-1300_*m*, 1400, 1500_1-1500*m* and 1600, and a control module 1700. In FIG. 10, the load units 1100_1-1100_*n* and the serial-parallel switch units 1300_1-1300_*m* are regarded as a whole structure, and the load units 1200_1-1200_*n* and the serial-parallel switch units 1500_1-1500_*m* are regarded as another whole structure, and the serial-parallel connection between the two whole structures are controlled by the serial-parallel switch unit 1400. Similarly, a third terminal of the serial-parallel switch unit 1600 can be used to connect another whole structure. Deduced by analogy, the electronic device 1000 can be formed by a plurality of whole structures. Moreover, the control module 1700 is used for controlling the states of the serial-parallel switch units 1300_1-1300_*m*, 1400, 1500_1-1500_*m* and 1600, so that the connection relations of the load units 1100_1-1100_*n* and 1200_1-1200_*n* are correspondingly varied long with a level variation of the input voltage VIN. Detailed circuit structures and operation principles of the components in the electronic device 1000 have been described in the aforementioned embodiment, so that detailed descriptions thereof are not repeated.

In summary, the serial-parallel switch units are used to switch the connection states of the load units, which are performed according to a level variation of the input voltage. In this way, the electronic device of the invention can be directed operated under the AC voltage without additionally configuring an AC/DC converter or using a transformer. Therefore, the electronic device of the invention has advantages of miniaturization and utilization convenience.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims and their equivalents.

What is claimed is:

1. An electronic device, comprising:

N load units, respectively having a first terminal and a second terminal, wherein the first terminal of a first load unit is used for receiving an input voltage, and the second terminal of an N-th load unit is coupled to ground, and N is an integer greater than 1;

(N−1) serial-parallel switch units, respectively having a first terminal to a fourth terminal, wherein the first terminal of each of the serial-parallel switch units receives the input voltage, the second terminal of an i-th serial-parallel switch unit is connected to the second terminal of an i-th load unit, the third terminal of the i-th serial-parallel switch unit is connected to the first terminal of an (i+1)-th load unit, and the fourth terminal of each of the serial-parallel switch unit is connected to ground, wherein i is an integer and $1 \leq i \leq (N-1)$; and a control module, for switching the serial-parallel switch units to a first state or a second state according to a level variation of the input voltage, wherein when the i-th serial-parallel switch unit is in the first state, the first terminal thereof is connected to the third terminal thereof, and the second terminal thereof is connected to the fourth terminal thereof, and when the i-th serial-parallel switch unit is in the second state, the first terminal and the fourth terminal thereof are isolated, and the second terminal thereof is connected to the third terminal thereof, wherein when the i-th serial-parallel switch unit is in the first state, the i-th load unit and the (i+1)-th load unit are connected in parallel with each other, and when the i-th serial-parallel switch unit is in the second state, the i-th load unit and the (i+1)-th load unit are connected in series with each other.

2. The electronic device as claimed in claim 1, wherein the electronic device is an illumination device, k is an integer and $1 \leq k \leq N$, and a k-th load unit comprises:

a light emitting diode string, for receiving a voltage of the first terminal of the k-th load unit, and comprising M light emitting diodes connected in series, wherein M is an integer greater than 1; and a shunt control unit, for providing M shunt paths through which the light emitting diodes are respectively conducted to the second terminal of the k-th load unit, and one-by-one conducting the shunt paths in a sequence started from a first shunt path when the input voltage is increased along with time, and one-by-one closing the shunt paths in a sequence started from an M-th shunt path when the input voltage is decreased along with time.

3. The electronic device as claimed in claim 2, wherein the shunt control unit comprises:

a reference current generator, for generating a reference current signal;

M first current controllers, coupled to the light emitting diodes, for providing the shunt paths and M sensing current signals, wherein a j-th first current controller detects a current flowing through a j-th shunt path, and generates a j-th sensing current signal, and j is an integer and $1 \leq j \leq (M-1)$; and a second current controller, coupled to a voltage sensor, the reference current generator and the first current controllers, for generating M shunt control signals, wherein the second current controller transmits back a j-th shunt control signal when the j-th sensing current signal is deviated from the reference current signal by a predetermined multiple, so that the j-th first current controller switches a conducting state or an impedance of the j-th shunt path.

4. The electronic device as claimed in claim 3, wherein the shunt control unit comprises:

a voltage sensor, for sensing a variation of the input voltage varied along with time, and producing a sensing voltage variation signal, wherein the second current controller further transmits back the shunt control signals according to the sensing voltage variation signal.

5. The electronic device as claimed in claim 2, further comprising:

a voltage control unit, coupled to the shunt control unit of each of the load units, for producing a reference voltage according to the input voltage, and extracting a plurality of node voltages formed by the light emitting diode string in the load units, so as to select a node voltage having a minimum voltage value from a part of the node voltages greater than the reference voltage to serve as a supply voltage, wherein the shunt control unit of each of the load units is operated under the supply voltage.

6. The electronic device as claimed in claim 5, wherein the voltage control unit comprises:

a first resistor, having a first end receiving the input voltage;

a first Zener diode, having a cathode coupled to a second end of the first resistor, and an anode coupled to ground;

a second resistor, having a first end receiving the input voltage;

a first N-type transistor, having a first terminal coupled to a second end of the second resistor, and a control terminal coupled to the cathode of the first Zener diode;

a first diode, having an anode coupled to a second terminal of the first N-type transistor, and a cathode generating the supply voltage;

a capacitor, having a first end coupled to the cathode of the first diode, and a second end coupled to ground;

S second diodes, wherein an anode of a t-th second diode receives a t-th node voltage, S is an integer greater than 1, and t is an integer and $1 \leq t \leq S$;

S third resistors, wherein a first end of a t-th third resistor is coupled to a cathode of the t-th second diode; and S second N-type transistors, wherein a first terminal of a t-th second N-type transistor is coupled to a second end of the t-th third resistor, second terminals of the second N-type transistors are coupled to the first end of the capacitor, and control terminals of the second N-type transistors are coupled to the cathode of the first Zener diode, Wherein levels of a first to an S-th node voltages are sequentially increased, layout areas of a first to an S-th second N-type transistors are sequentially decreased, and resistances of a first to an S-th third resistors are sequentially increased.

7. The electronic device as claimed in claim 1, wherein the control module comprises:

(N−1) serial-parallel control units, wherein an i-th serial-parallel control unit controls the i-th serial-parallel switch unit, so as to switch the i-th serial-parallel switch unit to the first state or the second state; and a buck unit, for lowering the input voltage, and accordingly generating a plurality of trigger signals, wherein the serial-parallel control units control the serial-parallel switch units according to the trigger signals.

8. The electronic device as claimed in claim 7, wherein the i-th serial-parallel switch unit comprises:

a first P-type transistor, having a first terminal coupled to the first terminal of the i-th serial-parallel switch unit, and a second terminal coupled to the third terminal of the i-th serial-parallel switch unit;

a third diode, having a cathode coupled to the second terminal of the first P-type transistor, and an anode coupled to the second terminal of the i-th serial-parallel switch unit;

a third N-type transistor, having a first terminal coupled to the anode of the third diode, and a second terminal coupled to the fourth terminal of the i-th serial-parallel switch unit;

a first potential control unit, coupled to the first terminal of the i-th serial-parallel switch unit, a control terminal of the first P-type transistor, and the i-th serial-parallel control unit; and a second potential control unit, coupled to the first terminal and the fourth terminal of the i-th serial-parallel switch unit, a control terminal of the third N-type transistor, and the first potential control unit, wherein the first potential control unit and the second potential control unit synchronously operate, so that the first P-type transistor and the third N-type transistor are simultaneously turned on or turned off according to a switch signal from the i-th serial-parallel control unit.

9. The electronic device as claimed in claim 8, wherein the first potential control unit comprises:

a fourth resistor, having a first end coupled to the first terminal of the i-th serial-parallel switch unit, and a second end coupled to the i-th serial-parallel control unit;

a second Zener diode, having a cathode coupled to the first end of the fourth resistor, and an anode coupled to the second end of the fourth resistor;

a fifth resistor, having a first end coupled to the first end of the fourth resistor, and a second end coupled to the control terminal of the first P-type transistor; and a second P-type transistor, having a first terminal coupled to the second end of the fifth resistor, a control terminal coupled to the second end of the fourth resistor, and a second terminal coupled to the second potential control unit.

10. The electronic device as claimed in claim 8, wherein the second potential control unit comprises:

a sixth resistor, having a first end coupled to the first potential control unit, and a second end coupled to the fourth terminal of the i-th serial-parallel switch unit;

a third Zener diode, having a cathode coupled to the first end of the sixth resistor, and an anode coupled to the second end of the sixth resistor;

a seventh resistor, having a first end coupled to the control terminal of the third N-type transistor, and a second end coupled to the second end of the sixth resistor; and a fourth N-type transistor, having a first terminal coupled to the first terminal of the i-th serial-parallel switch unit, a control terminal coupled to the first end of the sixth resistor, and a second terminal coupled to the first end of the seventh resistor.

11. The electronic device as claimed in claim 1, wherein the load units respectively comprises a resistor, a capacitor, an inductor, a diode, a bipolar transistor, a field effect transistor, a light emitting diode, a laser diode, a photo sensor, a signal receiver, a signal transmitter, a battery, a direct current power supply, or a combination thereof.

12. The electronic device as claimed in claim 1, further comprising a rectifier unit, for rectifying an alternating-current voltage, so as to generate the input voltage.

13. An electronic device comprising:

N first load units, respectively having a first terminal and a second terminal, wherein the first terminal of a 1st first load unit receives an input voltage, and N is an integer greater than 1;

(N−1) first serial-parallel switch units, respectively having a first terminal to a fourth terminal, wherein the first terminals of the first serial-parallel switch units are coupled to the first terminal of the 1st first load unit, the second terminal of an i-th first serial-parallel switch unit is coupled to the second terminal of an i-th first load unit, the third terminal of the i-th first serial-parallel switch unit is coupled to the first terminal of an (i+1)-th first load unit, and the fourth terminals of the first serial-parallel switch units are coupled to the second terminal of an N-th first load unit, wherein i is an integer and $1 \le i \le (N-1)$;

a second serial-parallel switch unit, having a first terminal to a fourth terminal, wherein the first terminal of the second serial-parallel switch unit receives the input voltage, the second terminal of the second serial-parallel switch unit is coupled to the second terminal of the N-th first load unit, and the fourth terminal of the second serial-parallel switch unit is coupled to ground; and a control module, for switching the first serial-parallel switch units and the second serial-parallel switch unit to a first state or a second state according to a level variation of the input voltage, wherein when the i-th first serial-parallel switch unit is in the first state, the first terminal thereof is conducted to the third terminal thereof, and the second terminal is conducted to the fourth terminal thereof, and when the i-th first serial-parallel switch unit is in the second state, the first terminal and the fourth terminal thereof are isolated, and the second terminal thereof is conducted to the third terminals thereof, wherein when the second serial-parallel switch unit is in the first state, the first terminal thereof is conducted to the third terminal thereof, and the second terminal is conducted to the fourth terminal thereof, and when the second serial-parallel switch unit is in the second state, the first terminal and the fourth terminal thereof are isolated, and the second terminal thereof is conducted to the third terminals thereof.

14. The electronic device as claimed in claim 13, wherein the electronic device is an illumination device, k is an integer and $1 \le k \le 2N$, and a k-th first load unit comprises:

a light emitting diode string, for receiving a voltage of the first terminal of the k-th first load unit, and comprising M light emitting diodes connected in series, wherein M is an integer greater than 1; and a shunt control unit, for providing M shunt paths through which the light emitting diodes are respectively conducted to the second terminal of the k-th first load unit, and one-by-one conducting the shunt paths in a sequence started from a first shunt path when the input voltage is increased along with time, and one-by-one closing the shunt paths in a sequence started from an M-th shunt path when the input voltage is decreased along with time.

15. The electronic device as claimed in claim 14, further comprising:

a voltage control unit, coupled to the shunt control unit of each of the first load units, for producing a reference voltage according to the input voltage, and extracting a plurality of node voltages formed by the light emitting diode string in the first load units, so as to select a node voltage having a minimum voltage value from a part of the node voltages greater than the reference voltage to serve as a supply voltage, wherein the shunt control unit of each of the load units is operated under the supply voltage.

16. The electronic device as claimed in claim 13, wherein the control module comprises:

N serial-parallel control units, wherein an i-th serial-parallel control unit controls the i-th first serial-parallel switch unit, so as to switch the i-th first serial-parallel switch unit to the first state or the second state, and an N-th serial-parallel control unit controls the second serial-parallel switch unit, so as to switch the second serial-parallel switch unit to the first state or the second state; and a buck unit, for lowering the input voltage, and accordingly generating a plurality of trigger signals, wherein the serial-parallel control units control the first serial-parallel switch units and the second serial-parallel switch unit according to the trigger signals.

17. The electronic device as claimed in claim 13, wherein the first load units respectively comprises a resistor, a capacitor, an inductor, a diode, a bipolar transistor, a field effect transistor, a light emitting diode, a laser diode, a photo sensor, a signal receiver, a signal transmitter, a battery, a direct current power supply, or a combination thereof.

18. The electronic device as claimed in claim 13, further comprising a rectifier unit, for rectifying an alternating-current voltage, so as to generate the input voltage.

19. The electronic device as claimed in claim 13, further comprising:

S second load units, respectively having a first terminal and a second terminal, wherein the first terminal of a first second load unit is coupled to the third terminal of the second serial-parallel switch unit, and S is an integer greater than 1;

(S−1) third serial-parallel switch units, respectively having a first terminal to a fourth terminal, wherein the first terminals of the third serial-parallel switch units are coupled to the first terminal of the first second load unit, the second terminal of a j-th third serial-parallel switch unit is coupled to the second terminal of a j-th second load unit, the third terminal of the j-th third serial-parallel switch unit is coupled to the first terminal of a (j+1)-th second load unit, and the fourth terminals of the third serial-parallel switch units are coupled to the second terminal of a S-th second load unit, wherein j is an integer and $1 \leq j \leq (S-1)$; and a fourth serial-parallel switch unit, having a first terminal to a fourth terminal, wherein the first terminal of the fourth serial-parallel switch unit receives the input voltage, the second terminal of the fourth serial-parallel switch unit is coupled to the second terminal of the S-th second load unit, and the fourth terminal of the fourth serial-parallel switch unit is coupled to ground, wherein the control module switches the third serial-parallel switch units and the fourth serial-parallel switch unit to the first state or the second state according to the level variation of the input voltage.

20. The electronic device as claimed in claim 13, further comprising:

P third load units, respectively having a first terminal and a second terminal, wherein the first terminal of a first third load unit is coupled to the third terminal of the second serial-parallel switch unit, and the second terminal of a P-th third load unit is coupled to ground, and P is an integer greater than 1;

(P−1) fifth serial-parallel switch units, respectively having a first terminal to a fourth terminal, wherein the first terminals of the fifth serial-parallel switch units are coupled to the first terminal of the first third load unit, the second terminal of a k-th fifth serial-parallel switch unit is coupled to the second terminal of a k-th third load unit, the third terminal of the k-th fifth serial-parallel switch unit is coupled to the first terminal of a (k+1)-th third load unit, and the fourth terminals of the fifth serial-parallel switch units are coupled to ground, wherein k is an integer and $1 \leq k \leq (P-1)$, wherein the control module switches the fifth serial-parallel switch units to the first state or the second state according to the level variation of the input voltage.

21. The electronic device as claimed in claim 13, further comprising:

a fourth load unit, having a first terminal and a second terminals, wherein the second terminal of the fourth load unit is coupled to ground; and a sixth serial-parallel switch unit, having a first terminal to a fourth terminal, wherein the first terminal of the sixth serial-parallel switch unit receives the input voltage, the third terminal and the fourth terminal of the sixth serial-parallel switch unit are respectively coupled to the first terminal and the second terminal of the fourth load unit, wherein the control module switches the sixth serial-parallel switch unit to the first state or the second state according to the level variation of the input voltage.

* * * * *